United States Patent [19]

Scuorzo

[11] Patent Number: 4,852,742

[45] Date of Patent: Aug. 1, 1989

[54] KIT ASSEMBLY FOR ORAL HYGIENE CARE

[76] Inventor: Kathleen Scuorzo, 2804 Billy Ct., Medford, N.Y. 11763

[21] Appl. No.: 281,533

[22] Filed: Dec. 8, 1988

Related U.S. Application Data

[63] Continuation-in-part of Ser. No. 112,950, Oct. 26, 1987, abandoned.

[51] Int. Cl.[4] ..... B65D 69/00

[52] U.S. Cl. ..... 206/568; 206/38; 206/219; 206/63.5; 206/581

[58] Field of Search ..... 206/37, 38, 219, 229, 206/63.5, 361, 362.2, 568, 581, 606, 823, 1.8; 229/125.35; 15/106, 105, 110

[56] References Cited

U.S. PATENT DOCUMENTS

| | | | |
|---|---|---|---|
| 1,699,939 | 1/1929 | Ansell | 206/37 |
| 1,955,175 | 4/1934 | Crowther | 206/63.5 |
| 2,196,801 | 4/1940 | Kreisler | 206/823 |
| 2,534,100 | 12/1950 | Baumgartner | 206/229 |
| 3,083,821 | 4/1963 | Woodson | 206/568 |
| 3,353,898 | 11/1967 | Lamberti | 206/581 |
| 3,426,888 | 2/1969 | Meth | 206/1.8 |
| 3,741,378 | 6/1973 | Parker | 206/361 |
| 4,294,349 | 10/1981 | Ibsen et al. | 206/568 |
| 4,328,892 | 5/1982 | Heitlinger | 206/38 |
| 4,341,302 | 7/1982 | Baker et al. | 206/568 |
| 4,344,535 | 8/1982 | Cognazzi | 206/229 |
| 4,427,148 | 1/1984 | Seiter et al. | 229/125.35 |
| 4,486,109 | 12/1984 | Rosfsky | 15/110 |
| 4,517,701 | 5/1985 | Stanford, Jr. | 15/106 |
| 4,588,089 | 5/1986 | Yanz, Jr. et al. | 206/63.5 |

*Primary Examiner*—David T. Fidei
*Attorney, Agent, or Firm*—Alfred M. Walker

[57] ABSTRACT

The present invention discloses a housing which provides for a rotation of a toothbrush head for mixing baking soda and an oxygenating agent within said housing. The mixing housing holds the toothbrush in engagement with the ingredients within the housing, thereby securely mixing the ingredients for use. The housing further includes an inwardly extending top surface having an opening to the reservoir of the housing. This construction further acts to effectively prevent spillage of the mixture and to contain and limit the lateral movement of the toothbrush head within the housing while permitting the wider, more extensive movement of the bristles within the reservoir of the housing, thereby maximizing rigidity of the housing during use.

3 Claims, 4 Drawing Sheets

KIT ASSEMBLY FOR ORAL HYGIENE CARE

This application is a Continuation-In-Part application of application Ser. No. 07/112,950, filed Oct. 26, 1987, now abandoned.

TECHNICAL FIELD OF THE INVENTION

The present invention relates to a kit assembly for oral hygiene and more particularly, the invention relates to a kit assembly, having a housing shaped to accommodate a toothbrush head, in combination with packets of pre-mixed ingredients, which housing provides a secure mixing bowl for the mixing of baking soda and an oxygenating agent by the toothbrush within the housing. The present invention is primarily designed for use as a means of conveniently mixing the ingredients for cleaning by applying the mixture to teeth and gums.

DESCRIPTION OF THE PRIOR ART

Heretofore, the art has included various types of dentifrice mixture processes, representative of which are Ansell, U.S. Pat. No. 1,699,939, Cagnazzi, U.S. Pat. No. 4,344,535, Ibsen, U.S. Pat. No. 4,294,349, Sompayrac, U.S. Pat. No. 4,226,851, Delaney, et. al., U.S. Pat. No. 3,937,804, Crocker, U.S. Pat. No. 2,128,917, Reiche, U.S. Pat. No. 2,120,430, Woldman, U.S. Pat. No. 2,090,437, Crowther, U.S. Pat. No. 2,024,146, Jones, U.S. Pat. No. 1,767,528, McDowell, U.S. Pat. No. 1,516,398, Wolf, U.S. Pat. No. 1,152,066, and Westenfelter, U.S. Pat. No. 1,112,180. Ansell, U.S. Pat. No. 1,699,939, is concerned with providing a housing for mixing ingredients, with an outwardly extending top surface to facilitate the removal of a top cover, and does not concern a mixing housing design which has an inwardly extending top surface having an opening into the reservoir of the housing for accommodating a toothbrush or other mixing apparatus. Cagnazzi U.S. Pat. No. 4,434,535, concerns a kit assembly for carrying a toothbrush and dentifrice material. The Ibsen U.S. Pat. No. 4,294,349 patent discloses a kit assembly having a plurality of containers with premixed ingredients for repair of porcelain dental prostheses. However, Ibsen does not provide a mixing housing for mixing the ingredients by a toothbrush. Crocker provides a tube for dispensing sodium bicarbonate, while McDowell discloses a chewing gum tablet being a receptacle for a pre-mixed quantity of dentifrice cleansing agents. It is submitted that the prior art fails to disclose or suggest an oral hygiene kit assembly, having a housing shaped to accommodate a toothbrush head, in combination with pre-mixed ingredients, which may easily and quickly be mixed within the housing for application by the brush upon the teeth or gums. For example, while the cross section of the exterior walls of the Ansell patent are wider at the bottom exterior than at the top exterior, the interior walls have a top opening which is equal in dimensions and shape to the bottom wall. Therefore, the toothbrush handle, or other mixing apparatus, is not limited in horizontal movement. This unlimited horizontal movement causes the Ansell container to tend to tip over as the vigorous horizontal mixing hand motions of the user cause the toothbrush handle to alternately strike the sides of the Ansell housing.

What is desirable is a dentifrice mixing container which will limit the lateral movement of the toothbrush handle, yet permit the more extensive vigorous movement of the bristles within mixing container. Additionally, the alternate constructions of the present invention includes a pre-mixed containers which assist in providing alternate dishes for thinning or thickening the mixture; a feature not disclosed in the prior art.

It is, therefore, an object of the present invention to provide an oral hygiene kit assembly which provides a housing having a secure fit for a toothbrush head, while preventing lateral movement or overturning of the housing during mixing.

It is an additional object of the invention to provide an integral structure for a mixing bowl assembly which permits easy and expedient removal of the toothbrush head and ingredients.

It is, yet, a further object of the present invention to provide pre-packaged ingredient containers having pre-measured quantities for mixing by common toothbrush heads within the housing.

It is an additional object of the invention to provide a mixing housing of the kit assembly with maximum rigidity during use.

It is, yet a further object of the invention to provide the alternate mixing housings to thicken and thin the pre-packaged ingredients.

It is a further object of the present invention to overcome the deficiencies and disadvantages inherent in the prior art.

SUMMARY OF THE INVENTION

The foregoing and related objects are achieved by an oral hygiene kit assembly having a secure housing to accommodate a toothbrush head, wherein a premeasured ingredient within the housing is mixed by the toothbrush within the housing with other premeasured ingredients. The present invention discloses a housing which provides for a rotation of a toothbrush head for mixing baking soda and an oxygenating agent within said housing. The mixing housing includes a hollow hexahedron parallepiped having longitudinally extending sides intersecting the plane of front and rear edges, wherein said sides and edges have a common bottom plane, to hold the toothbrush in engagement with the ingredients within the housing, thereby securely mixing the ingredients for use. The housing further includes an inwardly extending top surface having an opening to the reservoir of the housing. The length of the opening in the top surface is less than the length of the interior length of reservoir chamber. This construction further acts to effectively prevent spillage of the mixture and to contain and limit the lateral movement of the toothbrush head within the housing while permitting the wider, more extensive movement of the bristles within the reservoir of the housing, thereby maximizing rigidity of the housing during use.

BACKGROUND OF THE INVENTION

For those dental patients who have bleeding gums, dentists and hygienists recommend the daily usage of hydrogen peroxide and baking soda. The purpose of this combination is to stop the bleeding and to shrink any swelling of the gum tissue. This is important to the individual because what actually holds the teeth into place is the gum, and underneath the gum is bone. While the gums are unhealthy the bone is deteriorating and if left alone, the bone will deteriorate to the point where the teeth will become mobile, and many patients will actually lose their teeth due to the lack of proper care and attention.

At any time there are several bacteria within the oral cavity. The bacteria that is necessary in the oral cavity are oxygenating bacteria, however, when the gums are unhealthy bacteria live and multiply in non-oxygenating areas such as the oral cavity. The hydrogen peroxide brings oxygen to the gums so that the non-beneficial bacteria are destroyed, since it cannot live in oxygenating areas.

The purpose of the baking soda, since it has a high sodium content, is to bring down any swelling of the gums and give a firmer texture to the gums.

The combination of hydrogen peroxide and the baking soda on a daily schedule will reduce and even stop any bleeding of the gums and will also tighten and shrink the gum tissue to its proper texture. When this level is achieved, the dental patient's gums will be healthy and the chances of any tooth loss are reduced.

As previously stated, dentists and hygienists highly recommend the daily usage of hydrogen peroxide and baking soda to their patients. But for some reason the patients use it for a short time with some positive results, but then they would discontinue the usage because of the inconvenience of measuring and mixing.

Dental patients feel that it is time-consuming to get the baking soda box out, the bottle of hydrogen peroxide, decide what to mix it in, how many days can it be premixed and where to store the ingredients.

Other objects and features of the present invention will become apparent when considered in view of the accompanying drawings. It should, of course, be understood that the drawing is intended to be merely illustrative of the present invention and is not intended as a definition of the scope of limitations thereof.

BRIEF DESCRIPTION OF THE DRAWINGS

In the drawings, wherein similar reference numerals denote similar features throughout the several views.

DETAILED DESCRIPTION OF THE DRAWING

Figure 1:
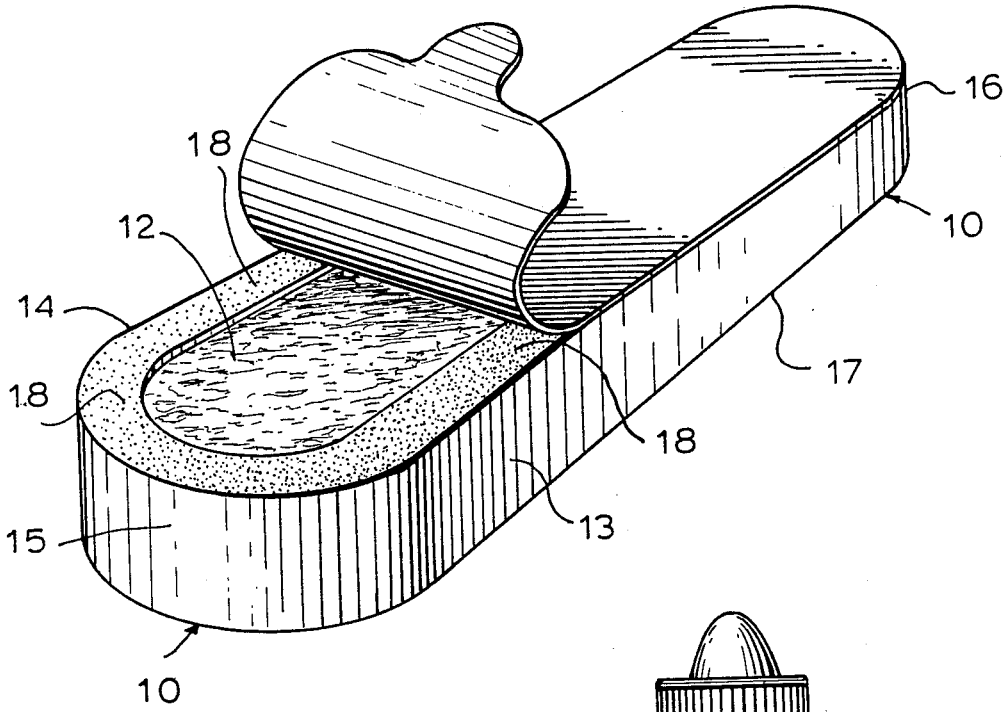
FIG. 1 is a perspective view of the mixing container of the invention

Turning now, in detail to FIGS. 1, 2, 3 and 4 of the drawing, the kit assembly includes, generally hexahedron parallelepiped shape, into which is inserted a toothbrush head 11. The housing 10 of the present invention includes a hollow reservoir chamber 12 which contains a premeasured amount of baking soda. Toothbrush head 11 is inserted into reservoir chamber 12 of housing 10, which housing 10 includes also parallel longitudinally extending sides 13 and 14, intersecting the planes of parallel front and rear edges 15 and 16, wherein the sides 13 and 14 and edges 15 and 16 have a common bottom 17. The housing 10 also includes inwardly extending top surface 18 containing an opening to the reservoir chamber 12 of the housing 10 to accommodate the movement of the brush bristles of toothbrush head 11, within reservoir chamber 12 of housing 10. The top surface 18 acts to prevent excessive lateral movement of the toothbrush head within the reservoir chamber 12 of housing 10, so that the toothbrush head is limited in movement by and snugly fits within the opening of the top surface 18 of housing 10, while the rotating bristles move more extensively below the top surface 18 of the housing 10 and within the reservoir chamber 12.

Figure 5:
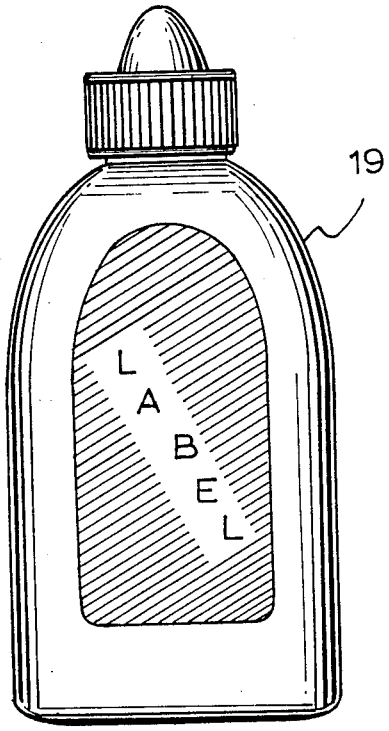
FIG. 5 is a front view of another ingredient container.
Figure 2:
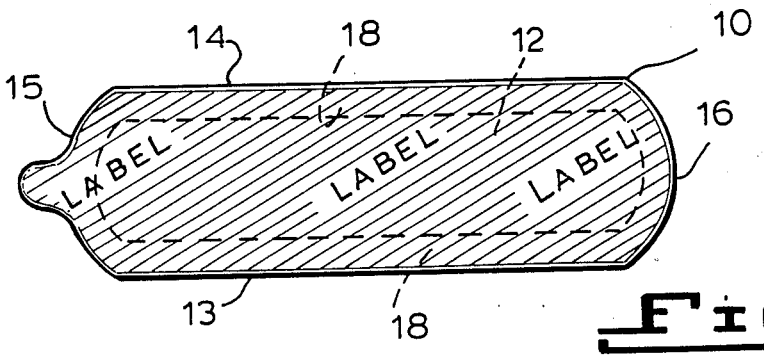
FIG. 2 is a top view of the closed mixing container of the invention.
Figure 3:
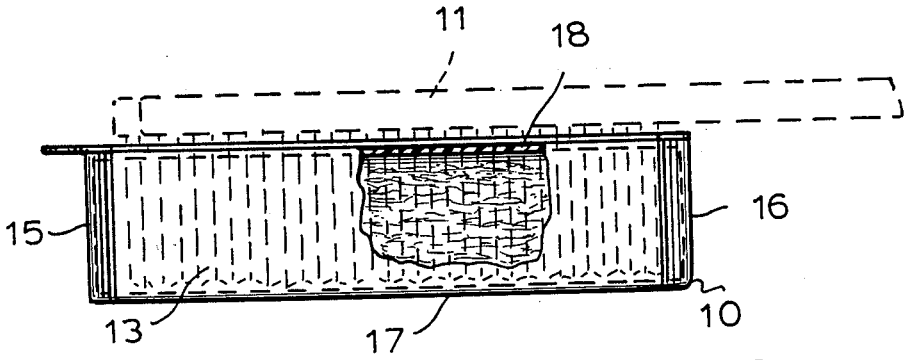
FIG. 3 is a side elevational view of the closed mixing container of the present invention as shown in FIG. 1.
Figure 4:
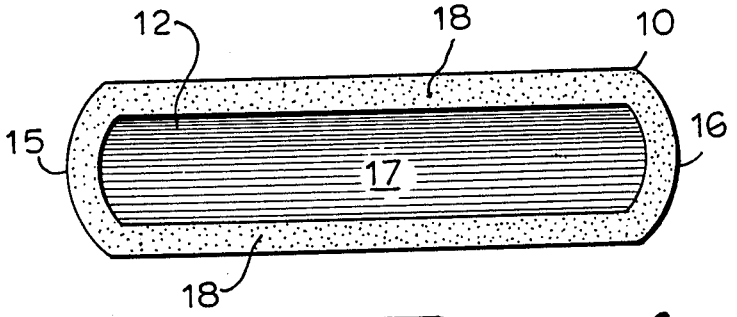
FIG. 4 is a top view of the mixing container with the top seal removed.

Housing 10 contains a premeasured amount of baking soda, which is mixed within reservoir chamber 12 of housing 10 with hydrogen peroxide dispensed in premeasured quantities from bottle container 19, as shown in FIG. 5.

Before use, baking soda within housing 10 is sealed by a peel off label so that the container may be discarded after use.

Figure 6:
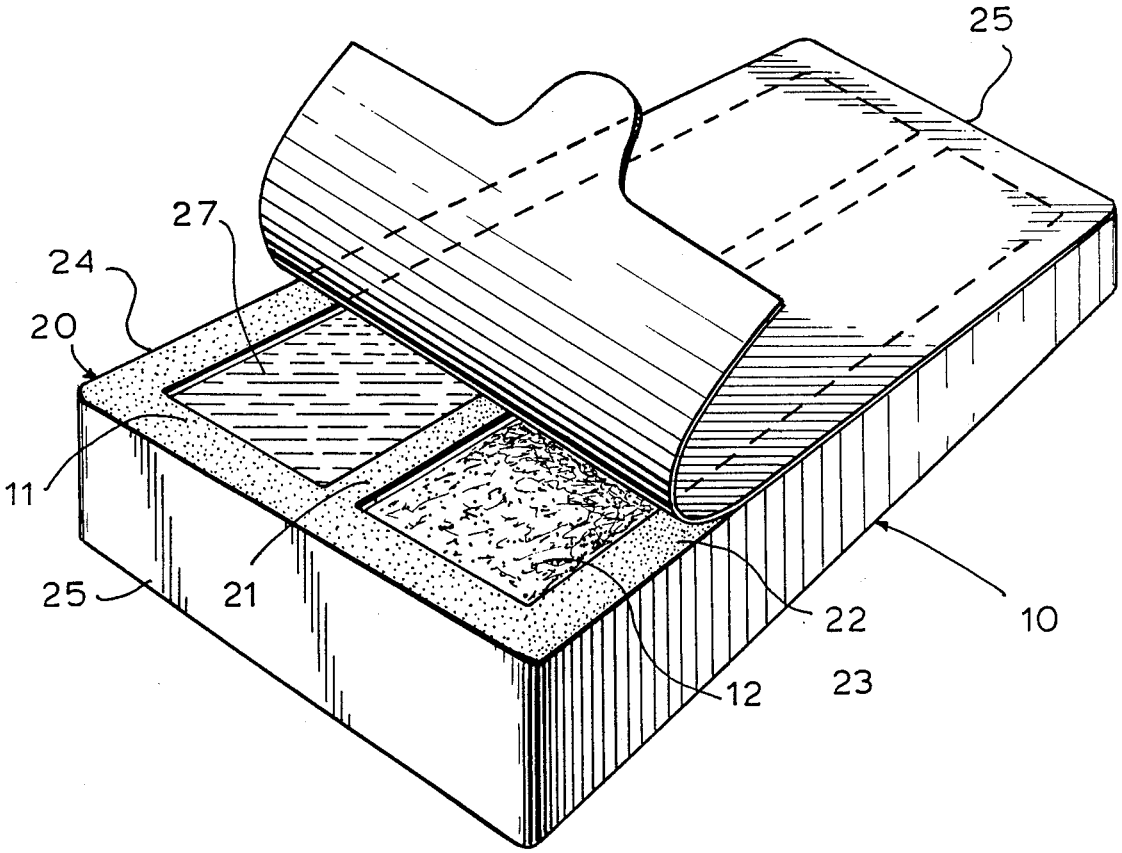
FIG. 6 is a top view of another embodiment of the mixing container showing two mixing chamber.
Figure 8:
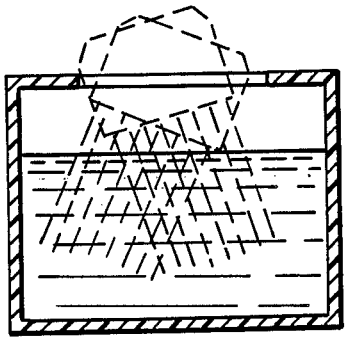
FIG. 8 is a cross sectional view of the device showing the toothbrush head and bristles in rotation.

A further embodiment of the kit assembly is shown in FIG. 6, wherein the hydrogen peroxide is dispensed from a generally hexahedron parallelepiped shaped housing container 20 adjacent to housing 10, such that housing 10 and 20 share common longitudinally extending side 21 and a generally "FIG. 8" shaped inwardly extending top surface 18 having an opening to reservoir chamber 12 located on the top edges of the longitudinally extending sides 21, 23 and 24, and common front and rear edges 25 and 26. In this embodiment, there is no need for bottle container 19, since the hydrogen peroxide is dispensed from chamber 27 of adjacent housing 20.

This allows thickening and thinning of the mixture by moving the hydrogen peroxide incrementally from chamber 27 of housing 20 into chamber 12 of housing 10, so as to be mixed with the baking soda contained within reservoir chamber 12 of housing 10.

Figure 7:
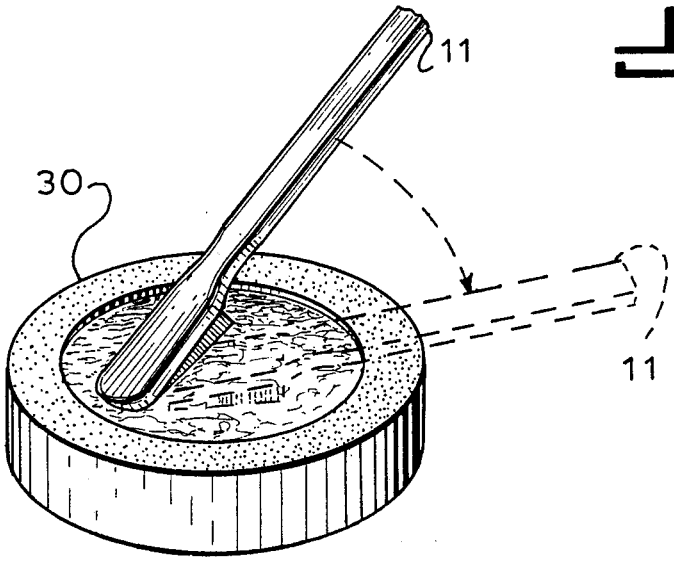
FIG. 7 is a top view of another embodiment of the mixing container showing a cylindrical shape.

A further embodiment is shown in FIG. 7, wherein housing 30 is generally cylindrically shaped, to accommodate the rotational movement of toothbrush head 11 within chamber 31 of chamber 30.

The present invention provides a kit assembly having a container or plurality of containers shaped to accommodate a toothbrush head for mixing premeasured ingredients within said container or containers, which provide stability and rigidity during use. The various embodiments are not shown in the prior art, nor are the advantages obtained by the kit assembly found in any prior art devices.

Although the present invention has been described with respect to the preferred embodiment, it is not to be so limited to the embodiment shown. The present invention is illustrative and not restrictive, the scope of the invention being indicated by the appended claims rather than by the aforegoing description.

I claim:

1. A dental oral hygiene kit assembly comprising:

a housing to accommodate a toothbrush head, said housing being a generally hollow hexahedron parallelepiped having two longitudinally extending sides intersecting the planes of a front planar edge and a rear planar edge, said sides and planar edges having a common bottom plane, said housing defining a reservoir chamber therein;

a premeasured unit of baking soda within said housing;

a container containing a premeasured unit of an oxygenating agent;

said sides and planar edges being constructed to accommodate the mixing of said baking soda and said oxygenating agent by the movement of said toothbrush head within said housing, and, an inwardly extending top surface located upon and extending inward from the perimeter of the opening of said housing, said top surface having an opening to said reservoir chamber, said top surface being capable of permitting the movement of the bristles of said toothbrush head within said housing while restricting excessive lateral movement of said toothbrush head within said reservoir chamber of said housing.

2. The invention according to claim 1, wherein the oxygenating agent is contained in a generally hollow hexahedron parallelepiped shaped container adjacent to said housing containing said baking soda, said housing and said container sharing a common longitudinally extending side wall and said inwardly extending circumference lip being shaped in a generally figure 8 shape.

3. A dental oral hygiene kit assembly, comprising:

a housing to accommodate a toothbrush head, said housing being cylindrically shaped and defining a reservoir chamber therein;

a premeasured unit of baking soda within said housing;

a container containing premeasured units of an oxygenating agent;

said housing shaped to accommodate said toothbrush head to mix said baking soda and said oxygenating agent within said housing, and an inwardly extending top surface located upon and extending inward from the perimeter of the opening of said housing, said top surface having an opening to said reservoir chamber, said top surface being capable of permitting the movement of the bristles of said toothbrush head within said housing while restricting excessive lateral movement of said toothbrush head within said reservoir chamber of said housing.

* * * * *